US006445804B1

(12) United States Patent
Hirayanagi

(10) Patent No.: US 6,445,804 B1
(45) Date of Patent: Sep. 3, 2002

(54) ULTRA-DIRECTIONAL SPEAKER SYSTEM AND SPEAKER SYSTEM DRIVE METHOD

(75) Inventor: Kouji Hirayanagi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/199,164

(22) Filed: Nov. 25, 1998

(30) Foreign Application Priority Data

Nov. 25, 1997 (JP) ..... 9-322546

(51) Int. Cl.[7] ..... H04R 5/02; H04R 25/00; H04R 3/00

(52) U.S. Cl. ..... 381/303; 381/150; 381/160; 381/117

(58) Field of Search ..... 381/303, 304–307, 381/77, 79, 111, 117, 150, 160

(56) References Cited

U.S. PATENT DOCUMENTS

| | | | | |
|---|---|---|---|---|
| 4,823,908 A | * | 4/1989 | Tanaka et al. | 381/160 |
| 5,687,239 A | * | 11/1997 | Inanaga et al. | 381/25 |
| 6,052,336 A | * | 4/2000 | Lowery, III | 367/139 |
| 6,229,899 B1 | * | 5/2001 | Norris et al. | 381/77 |

FOREIGN PATENT DOCUMENTS

| | | |
|---|---|---|
| JP | 61-264995 | 11/1986 |
| JP | 1-309500 | 12/1989 |
| JP | 3-159400 | 7/1991 |
| JP | 3-29335 | 12/1991 |
| JP | 6-233397 | 8/1994 |
| JP | 8-149592 | 6/1996 |

* cited by examiner

*Primary Examiner*—Forester W. Isen
*Assistant Examiner*—Laura A. Grier
(74) *Attorney, Agent, or Firm*—Whitham, Curtis & Christofferson, PC

(57) ABSTRACT

An ultra-directional speaker system has a speech generation means, an ultrasonic generation means, an amplitude modulation means to which the speech generation means and ultrasonic generation means are connected, an electro-acoustic transducer means which converts an ultrasonic modulated signal that is output from the amplitude modulation means to an acoustic signal, and a virtual sound source positioning means that establishes the position of a virtual sound source by detecting the position of a listener by detecting the ultrasonic waves that are output from the electro-acoustic transducer means and reflected from the listener.

14 Claims, 4 Drawing Sheets

ULTRA-DIRECTIONAL SPEAKER SYSTEM AND SPEAKER SYSTEM DRIVE METHOD

BACKGROUND OF THE INVENTION

1. Field of the Invention

The present invention relates to an ultra-directional speaker system and to a method of driving an ultra-directional speaker system, and more specifically it relates to an ultra-direction speaker system that uses ultrasonic waves and provides high directionality and provides an optimum acoustic signal to a location at which a listener exists.

2. Background of the Invention

In the past, there has been a known ultra-directional speaker system that used ultrasonic waves and provided high directionality.

Specifically, in an ultra-directional speaker system that used a parametric speaker system in the past, the existence of a listener in an audible region was detected by detected reflected sound.

For example, in the Japanese Unexamined Patent Publication (KOKAI) No. 3-159400, there is disclosure of technology for an ultra-directional speaker system which uses a speech signal and ultrasonic waves and which provides high directionality. More specifically, an ultrasonic signal of a prescribed frequency is used as a carrier wave, this being amplitude modulated by a speech signal, the resulting modulated signal being output via an ultrasonic vibration element.

In the above-noted patent publication, there is further noted in that acoustic vibration that is output from the speaker and reflected from a listener is detected and the sound source is switched.

FIG. 5 and FIG. 7 illustrate the principle of an ultra-directional speaker system according to the prior art.

As shown in FIG. 7, this has a speech generation means 101, an ultrasonic generation means 120, an amplitude modulation means 131 that is connected to the speech generation means 101 and the ultrasonic generation means 120, an electro-acoustic transducer means 104 which converts an ultrasonic modulated signal that is output by the amplitude modulation means 131, if desired passed through an amplification means 132, to an acoustic signal, and wherein the ultrasonic modulated signal that is output from the electro-acoustic transducer means 104 striking a listener 105 and being reflected, this reflection wave being detected by the acoustic detector 121, the controller 122 switching the input signal switch 123 in accordance with whether or not there is a listener in an audible range, a selection being made thereby of the input signal from either speech generator (A) 111 or the speech generator (B) 112.

By doing the above, the required information is only passed in the case in which there is a listener 105, and in the case in which there is no listener, it is possible, for example, to play background music.

In the Institute of Electronics and Communications Engineers Technical Report EA-94-37 (1994-08, pp. 25–30, "Spatial Sound Source Using a Parametric Array Beam"), there is indicated the use of a reflector to cause collected reflection of an acoustic vibration, thereby creating a virtual sound source.

That is, as shown in FIG. 8, which illustrates the configuration of the above-noted technology, this system comprising an ultra-directional speaker system 1 that has a speech generation means 10, an ultrasonic generation means 20, and an amplitude modulation means 30 that is connected to speech generation means 10 and the ultrasonic generation means 20, and an electro-acoustic transducer means 50 that converts an ultrasonic modulated signal that is output by the amplitude modulation means 30 to an acoustic signal, if desired passing through an amplifier means 40, and in that the ultrasonic modulated signal output from this ultra-directional speaker system 1 causes the acoustic vibration to be reflected and collected by the acoustic reflector 2, so that it strikes a listener as a virtual sound source that is positioned in front of the listener.

In the above-noted prior art ultra-directional speaker system, as shown in FIG. 5, the carrier used is an ultrasonic signal, that is, a high-frequency signal that is modulated by an appropriate speech signal that it the transmitted signal, this modulated signal being generated by amplitude modulation, and being output by the above-noted electro-acoustic transducer means.

The ultrasonic modulated signal is subject to distortion as it propagates through the air, and the envelope thereof is demodulated to restore it to its original form, enabling it to be heard as actual speech.

In addition to the above, in the Japanese Unexamined Patent Publication (KOKAI) No. 1-309500, there is disclosure of a technology whereby ultrasonic waves are caused to oscillate in an ultrasonic oscillator, verification being made by the speaker system as to the location of a listener, whereupon an optimum acoustic environment is formed at the location of the listener, with the acoustic signals that are output from a plurality of speaker systems are adjusted. There is in this publication, however, no disclosure of the use of an ultra-directional speaker system.

Additionally, in the Japanese Unexamined Patent Publication (KOKAI) No. 6-233397 as well, there is indicated an adjustment made in the same manner so as to form an optimum acoustic environment at the location of a listener, although this is also lacking a disclosure of the use of an ultra-directional speaker system.

In the above-noted prior art system as cited from the Japanese Unexamined Patent Application publication H3-159400, the following problems existed.

Specifically, the first problem is that it is not possible to maintain the acoustic output from the electro-acoustic transducer at all times at the optimum sound level.

The second problem is that, because the sound source is always fixed, the way the listener hears the sound will depend upon the distance with respect to the listener.

Even if the acoustic vibration is the same, if the sound source is at a distance of 1 meter it will be heard as sounding like it is at a distance of 1 meter away, and if it is at a distance of 1.5 meters, it will be heard as sounding like it is at a distance of 1.5 meters away, the respectively effects being different.

The reason for this is that because the information obtained from the acoustic detector is only whether or not a listener exists, it is not possible to know how far away the listener is.

For this reason, in prior art technology which used an ultra-directional speaker system, an attendant problem was that it was impossible to create the optimum acoustic environment from the standpoint of the listener at the position the listener occupies.

Accordingly, an object of the present invention is to provide an improvement over the above-noted problems which accompanied the prior art, by providing an ultra-directional speaker system that is capable of creating for a listener an ideal acoustic environment, without greatly changing the circuit configuration from that of the past, and without an increase in cost, and also to provide a method of driving such a speaker system.

Additionally, using an ultra-directional speaker system according to the present invention it is possible to provide a speaker system that performs automatic positioning.

SUMMARY OF THE INVENTION

To achieve the above-noted object, the present invention has the following basic technical constitution.

Specifically, the first aspect of the present invention is an ultra-direction speaker system that has a speech generation means, an ultrasonic generation means, an amplitude modulation means to which the speech generation means and the ultrasonic generation means are connected, an electro-acoustic transducer means that converts an ultrasonic signal that is output from the amplitude modulation means to an acoustic signal, and a virtual sound source setting means that detects a reflection wave from a listener of the ultrasonic wave that is output from the electro-acoustic transducer means and sets the position of a virtual sound source.

A second aspect of the present invention is a method for driving an ultra-direction speaker system that has a speech generation means, an ultrasonic generation means, an amplitude modulation means to which the speech generation means and the ultrasonic generation means are connected, an electro-acoustic transducer means that converts an ultrasonic signal that is output from the amplitude modulation means to an acoustic signal, and a virtual sound source setting means that detects a reflection from a listener of the ultrasonic wave that is output from the electro-acoustic transducer means and sets the position of a virtual sound source, whereby the position of a listener is detected from a reflection from the listener of the ultrasonic modulated wave that is output from the electro-acoustic transducer means, and the curve rate of an acoustic reflector is adjusted accordingly.

By adopting the above-noted technical constitutions, an ultra-directional speaker system and speaker system drive method according to the present invention, even if the listener moves, it is possible for the listener to hear sound that is from the same apparent position.

And thus, wherever the listener stays, he can perceive the sound from a sound source which is located at the most suitable place to listen it and further he can always listen the sound with the maximum sound pressure as large as possible.

In the present invention, that is, an automatic-positioning speaker system is provided, and in an automatic-positioning speaker system that makes used of the above-noted ultra-directional speakers, the distance with respect to a listener is calculated from a reflection from the listener of an acoustic wave that is radiated from an electro-acoustic transducer, the position of a vertical sound source being changed in accordance with this distance, so that the listener senses the virtual sound source as coming from a fixed position.

DESCRIPTION OF THE PREFERRED EMBODIMENTS

Preferred embodiments of an ultra-directional speaker system and speaker system drive method according to the present invention will be described in detail below, with references being made to relevant accompanying drawings.

Figure 1:
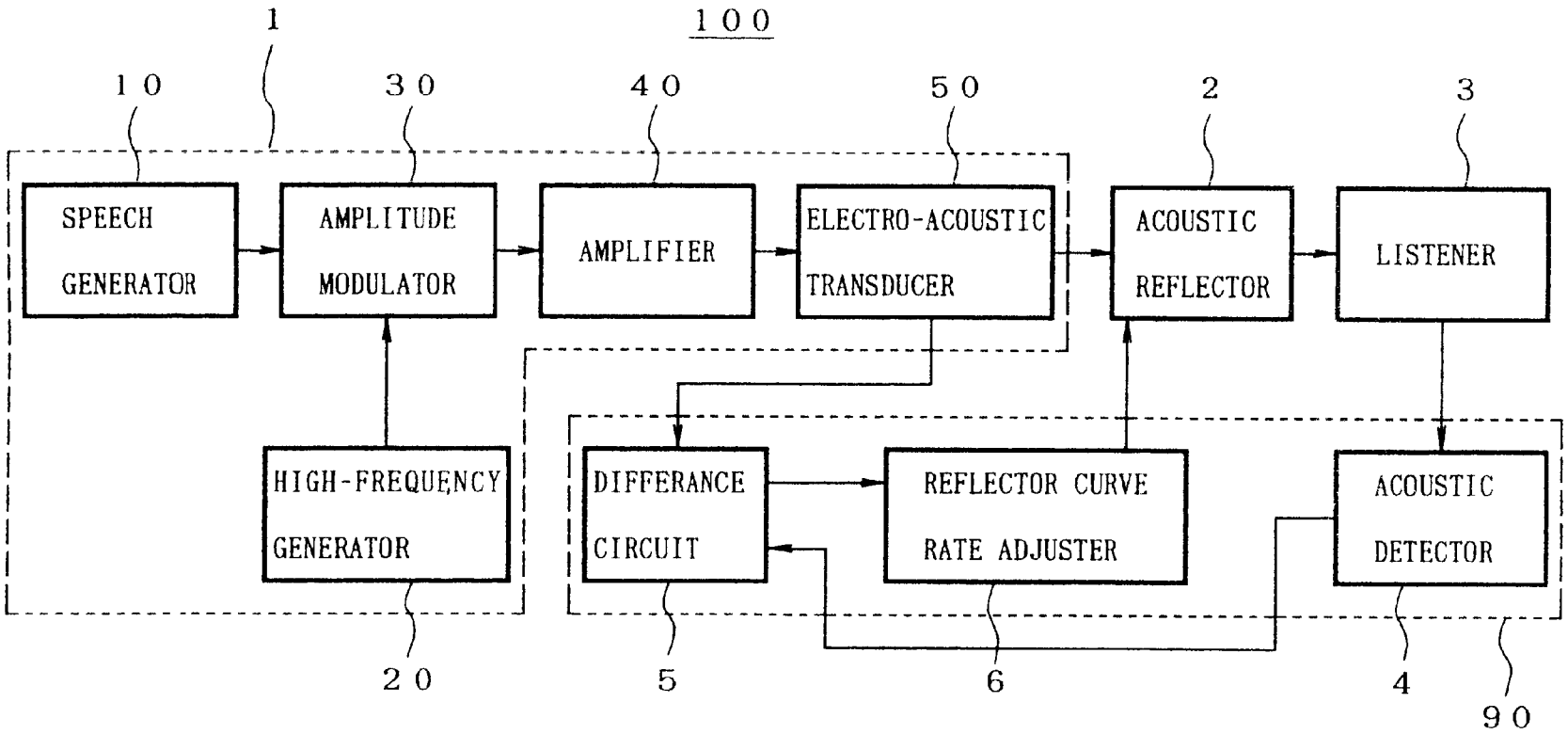
FIG. 1 is a block diagram that shows the configuration of an example of an ultra-directional speaker system according to the present invention.

Specifically, FIG. 1 is a block diagram that illustrates the configuration of an example of an ultra-directional speaker system according to the present invention, this figure showing an ultra-directional speaker system 100, this speaker having a speech generation means 10, an ultrasonic generation means 20, an amplitude modulation 30 means to which the speech generation means 10 and the ultrasonic generation means 20 are connected, an electro-acoustic transducer means 50 that converts an ultrasonic modulated signal that is output from the amplitude modulation means 30 to an acoustic signal, and a virtual sound source positioning means 90 that detects a reflection from a listener of the ultrasonic wave that is output from the electro-acoustic transducer means 50, and sets the position of a virtual sound source.

In this embodiment of the present invention, the speech generation means 10, the ultrasonic generation means 20, the amplitude modulation means 30, and the electro-acoustic transducer means 50 form an ultra-directional speaker 1.

In an ultra-directional speaker system according to the present invention, if necessary an amplification means 40 can be provided between the amplitude modulation means 30 and the electro-acoustic transducer means 50.

In this embodiment of the present invention, it is desirable that the ultrasonic generation means 20 be configured so as to generate an ultrasonic wave having a frequency in the range from several tens of kilohertz to several hundreds of kilohertz.

In an ultra-directional speaker system according to the present invention, the ultrasonic modulated wave that is output from the electro-acoustic transducer means 50 is first caused to be reflected, a reflection mean 2 that is formed by a reflecting plate that is configured so as to provide directionality toward a prescribe position being provided in proximity to the electro-acoustic transducer means 50.

It is desirable that the reflecting plate that forms the reflection means 2 have a curved reflecting surface, and further desirable that this reflecting plate have a radius of curvature such that can be arbitrarily changed.

Thus, in the present invention, it is desirable that a reflecting plate curve rate adjusting means 6 be provided in a virtual sound source setting means 90 for the purpose of appropriately changing the curve rate of the reflecting plate.

That is, the reflecting plate curve rate adjusting means 6 is configured so that it changes the curve rate of the reflecting plate in response to the position at which a listener 3 exists.

In one specific example of the present invention, an ultrasonic wave that is output at a prescribed time from the electro-acoustic transducer means 50 strikes a listener and is reflected therefrom, a calculation of the position of a listener 3 being performed based on the time difference of the ultrasonic wave returning to the position of the electro-acoustic transducer means 50.

More specifically, the virtual sound source setting means 90 is formed by an appropriate acoustic detector 4 that is provided in proximity to the electro-acoustic transducer means 50 that receives reflections from the listener 3 of an ultrasonic wave that is output from the electro-acoustic transducer means 50, a difference value calculation means 5 that calculates the time difference between the output from the electro-acoustic transducer means 50 and the time of detection of the reflection by the acoustic detector 4, and a reflection plate curve rate adjusting means 6.

In the present invention, the reflection plate curve rate adjusting means 6 is configured so as to change the curve rate of the reflecting plate in response to the output value from the calculation means 5.

A more specific example of an ultra-directional speaker system according to the present invention will be described in detail below.

Specifically, an ultra-directional speaker system according to the present invention is known as a automatic-positioning speaker apparatus, in which a reflection from a listener 3 of an acoustic vibration that is radiated from an electro-acoustic transducer 50 is detected and the distance with respect to the listener 3 is calculated, the reflecting plate curve rate adjusting means 6 being driven, in response to this distance, so that it changes the curve ratio of the reflecting plate so that a virtual sound source is positioned at a fixed position with respect to the listener 3.

In FIG. 1, a carrier signal generated from the high-frequency generator 20 is modulated by the speech signal generated by the speech generator 10 in the amplitude modulation means 30, this modulated signal is sufficiently amplified by the amplifier 40, and radiated as an acoustic vibration from the electro-acoustic transducer means 50.

The reflecting plate 2 is formed so as to have a curve that collects and reflects the vibration to the listener 3.

Because part of the ultrasonic waves that make up the acoustic vibration is reflected by the listener 3, and returns to the electro-acoustic transducer means 50, this part is detected by the acoustic detector 4 that is provided in proximity to the electro-acoustic transducer means 50, the distance between with respect to the listener 3 being calculated by the difference circuit 5, which calculates the time difference between the time that the modulated ultrasonic wave is output and the time the reflection returns.

Based on this calculated distance, the reflecting plate curve rate adjuster 6 changes the curve rate of the acoustic reflecting plate 2 so that the acoustic vibration is collected at a fixed position with respect to the listener 3.

By doing this, the acoustic vibration is always dispersed at a fixed position with respect to the listener 3, the result being that the listener 3 can perceive a virtual sound source as always being located at a fixed position, and receives a constant acoustic vibration at all times.

Referring to FIG. 1, the acoustic reflecting plate 2 has a structure that has a concave curved surface, so that it, by means of the curve rate thereof that is set by the reflecting plate curve rate adjuster 6, collects and directs the acoustic vibrations from the ultra-directional speaker 1, which is an ultra-linear acoustic vibration propagation circuit, toward the listener 3.

The acoustic detector 4 detects the returned reflection from the listener 3 of the acoustic vibration radiated toward the listener 3, and passing this to the difference circuit 5.

The difference circuit 5 calculates the distance with respect to the listener 3 from the difference in time from the radiated wave obtained from the amplifier 40 and the acoustic detector 4 and the time of the reflected wave, and passes this to the reflecting plate curve rate adjuster 6.

The reflecting plate curve rate adjuster 6 adjusts the curve rate of the reflecting plate 2 in response to the above-noted distance with respect to the listener 3.

Figure 2:
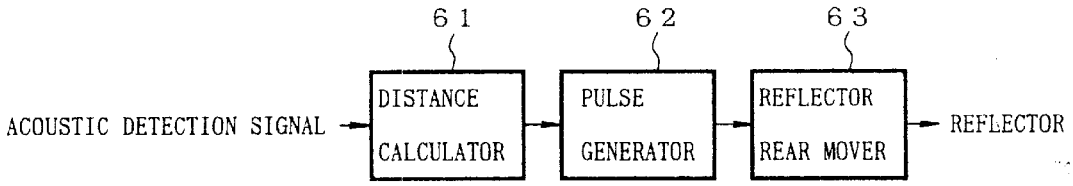
FIG. 2 is a block diagram that shows the configuration of an example of a reflector curve rate adjustment means that is used in an ultra-directional speaker system according to the present invention.
Figure 3:
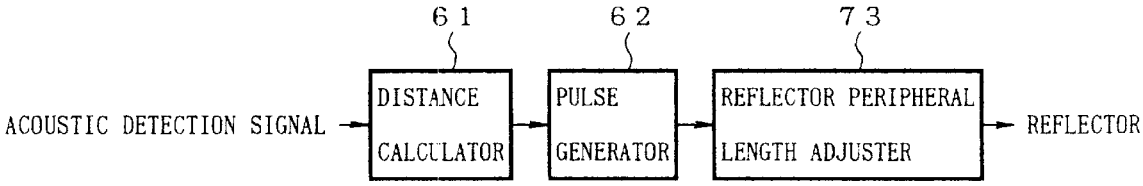
FIG. 3 is a block diagram that shows the configuration of a different example of a reflector curve rate adjustment means that is used in an ultra-directional speaker system according to the present invention.
Figure 4:
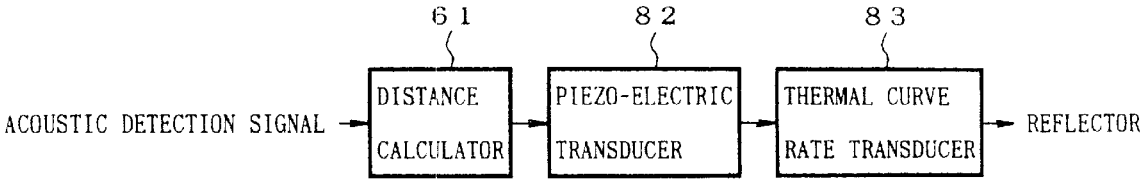
FIG. 4 is a block diagram that shows the configuration of a separate example of a reflector curve rate adjustment means that is used in an ultra-directional speaker system according to the present invention.

FIG. 2 through FIG. 4 are block diagrams that show an example of the configuration of the reflecting plate curve rate adjusting means that is used in the present invention.

In FIG. 2, the reflecting plate is configured so that a prescribed bias force acts at its center part, for example by an appropriate cam means, pulse motor means or the like, so that positive and negative bias forced is applied in the normal direction with respect to an apex at the center part of the curved surface, enabling the curvature condition of the reflecting plate to be thereby changed.

Thus, from the acoustic detection signal from the acoustic detection means, the distance calculator 61 calculates the distance to the listener, after which the pulse generator 62 generates a pulse signal in response to the distance to the listener.

Then, reflecting plate mover 63, which is made up of such elements as a cam means and pulse motor means, applies pulling or pushing force to the rear part of the reflecting plate in response to the above-noted pulse signal, so as to change curve rate thereof.

FIG. 3 is a block diagram that shows an example of the use of using a reflecting plate adjuster 6 that has a reflecting plate adjuster 73 in place of the reflecting plate mover 63.

Specifically, in this example, the reflecting plate adjuster 73 grabs the peripheral edge of the reflecting plate and changes the position of the peripheral edge of the reflecting plate so as to change the curve rate of the reflecting plate.

The drive of the grabbing mechanism for the peripheral edge of the reflecting plate in this example can be the same type that is used in the previously presented example.

In the example that is shown in FIG. 4, an electro-thermal transducer 82 converts electrical energy responsive to the distance to an object to thermal energy. The reflecting plate in this case, for example, is configured as a curved metal structure made of a bi-metal material, and a thermal curve rate transducer 83 causes the curve rate of the reflecting plate to change in response to the amount of thermal energy.

Next, the operation of the specific circuit example shown in FIG. 1 will be described with reference to FIG. 1.

In this embodiment, the ultra-directional speaker, which forms an ultra-linear acoustic vibration radiating circuit, is a so-called parametric array speaker.

That is, a carrier of ultrasonic frequency is modulated by a frequency in the audible frequency range, the resulted amplitude modulated signal being radiated through the space, the non-linear characteristics of the air being utilized to demodulate the audible sound. In the case of the present invention, the above-noted ultrasonic band frequency is, for example, 40 kHz.

The electro-acoustic transducer 50 is an ultrasonic transducer with an operating voltage of 60 volts, the maximum acoustic vibration collection point being at a location that is 30 cm in front of a listener.

The speech is prerecorded so that, with the listener at a distance of 30 cm, the optimum acoustic affect is achieved.

In this embodiment, the speech single generated from the speech generator 10 and is used to amplitude modulate the 40-kHz carrier signal generated by the high-frequency oscillator, using the amplitude modulator 30.

This amplitude modulated signal is amplified by the amplifier 40 up to 60 volts, which is capable of driving the electro-acoustic transducer 50.

The electro-acoustic transducer 50 converts the amplified signal to an acoustic vibration, which is radiated into space. The acoustic vibration that is thus radiated into space becomes a distorted waveform because of the non-linear characteristics of the air, and is demodulated while propagating through the air into the original audible sound.

Figure 5:
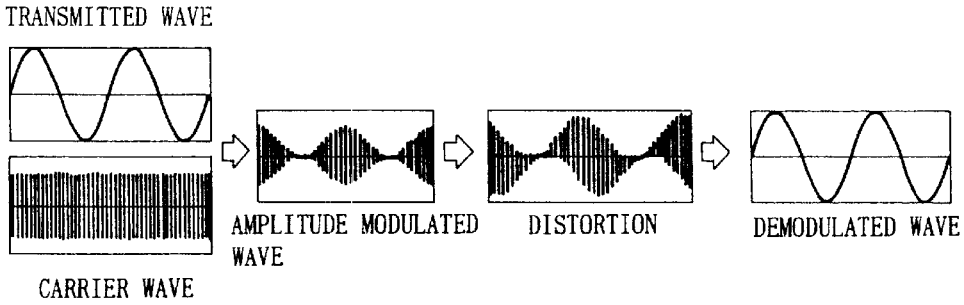
FIG. 5 is a drawing that illustrates the principle of speech propagation in an ultra-directional speaker system.

Referring to FIG. 5, the speech signal generated from the speech generator 10 is the transmitted wave and the 40-kHz signal generated from the high-frequency generator 20 is the carrier wave. The transmitted wave and the carrier wave are amplitude modulated by the amplitude modulator 30.

Additionally, the amplitude modulated signal is amplified by the amplifier 40, and radiated into space by the electro-acoustic transducer 50, the non-linear characteristics of the air causing faster movement when the air is moving in the forward direction and slower movement when the air is moving in the reverse direction, this causing distortion of the sound waves, resulting in demodulation to the original audible sound.

The acoustic reflecting plate 2 reflects and collects the acoustic vibrations that are radiated in a dispersed manner by the ultra-directional speaker 1, which is an ultra-linear acoustic wave radiating circuit.

The degree to which the reflecting plate 2 collects the vibrations is established by the curve rate of the reflecting plate 2, the curve rate being in turn controlled by the reflecting plate curve rate adjuster 6.

The acoustic vibrations that are radiated in a collected manner are collected at a position that is 30 cm in front of the listener, from which point they are radiated in a dispersed manner. Therefore, as seen from the listener 3, the dispersed radiation is sensed as occurring from a position that is 30 cm in from of the speaker, this having the effect of creating a virtual sound source at this point.

Consider the case in which the above-noted listener now moves 5 cm forward. The distance from the ultra-directional speaker 1, which is an ultra-linear acoustic wave radiating circuit, is now shortened by 5 cm, and the distance to the acoustic detector, when we consider the reflections returning from the listener, is now 10 cm shorter.

For this reason, the acoustic detector 4 detects the acoustic vibration over a path that shortened by 10 cm, meaning that the detection occurs 10 cm/340 m second earlier. This difference is calculated by the different circuit 5, and the reflecting plate curve rate adjuster 6 adjusts the curve rate of the acoustic reflecting plate 2 according to this calculated difference, thereby changing the point of collection of the acoustic vibrations to a position that is 5 cm forward from the original position.

Next, another embodiment of the present invention will be described, with reference being made to FIG. 6.

Figure 6:
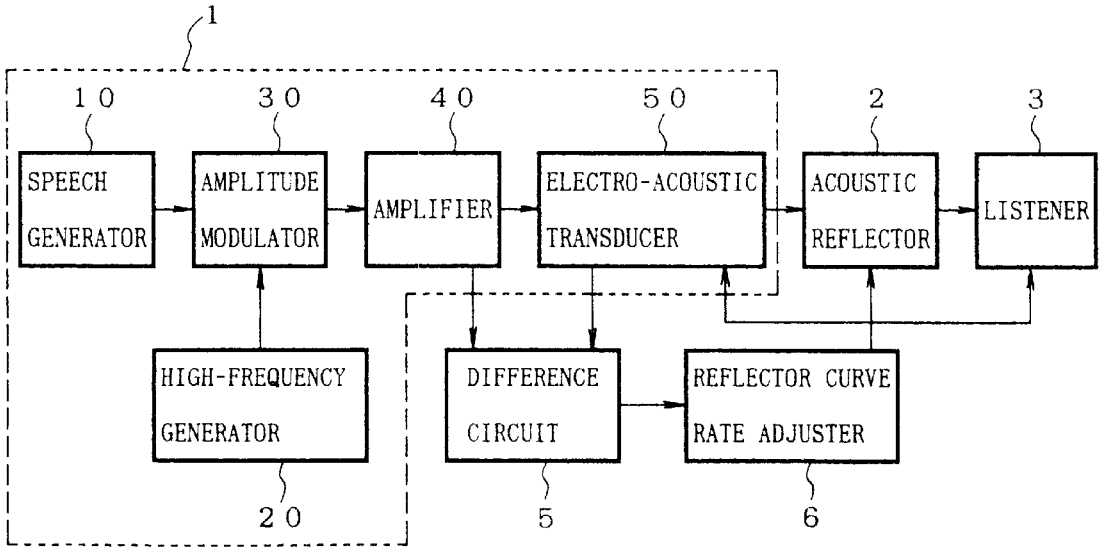
FIG. 6 is a block diagram that shows the configuration of a different example of an ultra-directional speaker system according to the present invention.
Figure 7:
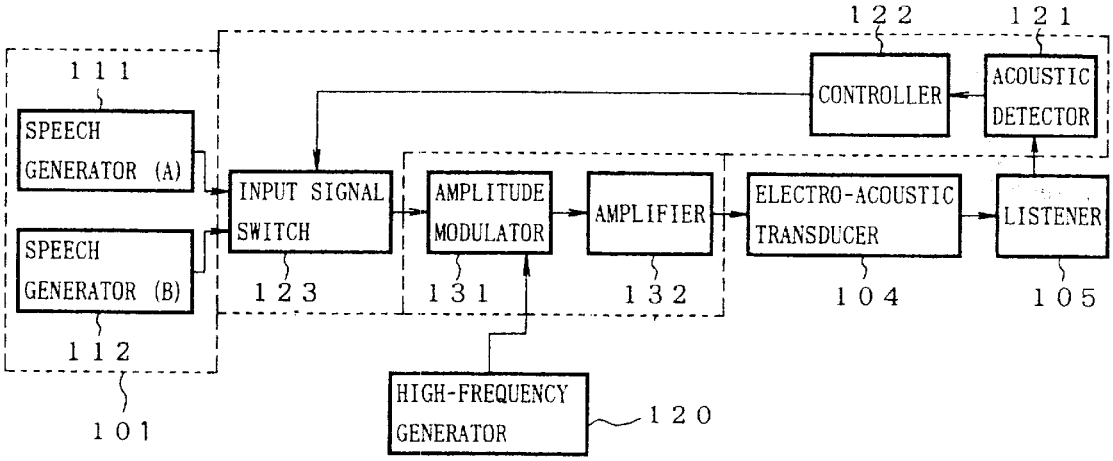
Fig. 7 (Prior Art)
FIG. 7 is a block diagram that shows the configuration of an example of an ultra-directional speaker system according to the prior art.
Figure 8:
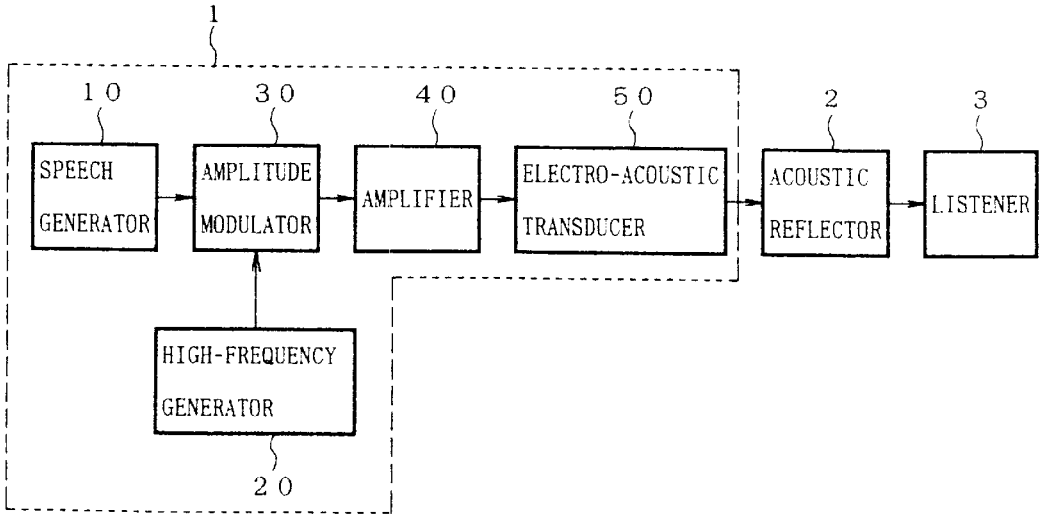
Fig. 8 (Prior Art)
FIG. 8 is a block diagram that shows the configuration of a different example of an ultra-directional speaker system according to the prior art.

In FIG. 6, the electro-acoustic mutual transducer 50 performs sending and receiving of an acoustic vibration with one and the same element.

That is, the electro-acoustic transducer 50 that is used to send and receive acoustic vibration and the acoustic detector 4, which are shown in FIG. 1, are provided by the same ultrasonic transducer.

By this single ultrasonic transducer, it is possible to use the two functions of sending and receiving simultaneously, thereby reducing the two required ultrasonic transducers to just one ultrasonic transducer.

Therefore, the detection signal calculation is performed by the difference in the electrical signals established by the amplified signal from the amplifier 40 and the returned signal that is actually detected by the electro-acoustic mutual transducer 50 is calculated by the difference circuit 5.

In this embodiment, the new achieved effect is that the two elements that were previously required for sending and receiving are reduced to just one element.

By adjusting the amplification of the amplifier 40 in accordance with the distance information of the acoustic detector 4 in FIG. 1, it is possible to provide a constant sound level to the listener at all times. The same type of implementation is also possible with regard to the switching of sound sources as was done in the prior art.

As is clear from the above description, a second embodiment of the present invention is a drive method for use with an ultra-directional speaker system that has a speech generation means, an ultrasonic generation means, an amplitude modulation means to which the speech generation means and the ultrasonic means are connected, and an electro-acoustic transducer means which converts an ultrasonic modulated signal that is output from the amplitude modulation means to an acoustic signal, and a reflecting plate which reflects the ultrasonic modulated signal that is output from the electro-acoustic transducer means so as to cause it to be directed to a prescribed position, in which drive system the curve rate of the reflecting plate is adjusted in accordance with position of the listener as detected from the ultrasonic acoustic signal that is reflected from the listener. In a specific example, the detection of the position at which a listener exists is done by calculating the time difference between the time at which the ultrasonic modulated signal is output form the electro-acoustic transducer means and the time at which the reflected ultrasonic modulated signal returns to the proximity of he electro-acoustic transducer means.

Additionally, in a speaker drive system according to the present invention, it is desirable that the curve rate of the reflecting plate be adjusted in response to the above-noted difference value.

By adopting the constitutions described above, an ultra-directional speaker system and ultra-directional speaker system drive method according to the present invention are capable of causing a listener to perceive sound as coming from the same position constantly, even if the listener moves.

And thus, wherever the listener stays, he can perceive the sound from a sound source which is located at the most suitable place to listen it and further he can always listen the sound with the maximum sound pressure as large as possible.

This is possible by measuring the distance to the listener and positioning a virtual sound source at a constant position with respect to the speaker.

What is claimed is:

1. An ultra-direction speaker system, comprising:

a speech generation means;

an ultrasonic generation means;

an amplitude modulation means to which said speech generation means and said ultrasonic generation means are connected;

an electro-acoustic transducer means that converts an ultrasonic signal that is output from said amplitude modulation means to an acoustic signal; and a virtual sound source setting means that detects a reflection wave from a listener of an ultrasonic wave that is output from said electro-acoustic transducer means and sets a position of a virtual sound source.

2. An ultra-directional speaker system according to claim 1, further comprising an amplifier means that is disposed between said amplitude modulation means and said electro-acoustic transducer means.

3. An ultra-directional speaker system according to either claim 1, wherein said ultrasonic generation means generates an ultrasonic wave in the frequency range from several tens of kilohertz to several hundreds of kilohertz.

4. An ultra-direction speaker system according to claim 1, further comprising a reflecting means that reflects an ultrasonic modulated wave that is output from said electro-acoustic transducer means, said reflecting means being provided in proximity to said electro-acoustic transducer means.

5. An ultra-directional speaker system according to claim 4, wherein said reflecting means comprises a reflecting surface that has a curved shape.

6. An ultra-directional speaker system according to claim 5, wherein a curvature radius of said reflecting means can be changed.

7. An ultra-directional speaker system according to claim 5, further comprising a reflecting means curve rate adjusting means for the purpose of changing the curve rate of said reflecting means.

8. An ultra-directional speaker system according to claim 7, wherein said reflecting means curve rate adjusting means can change the curve rate of said reflecting means in response to a position of said listener.

9. An ultra-directional speaker system according to claim 8, wherein a position at which said listener exists is calculated by detecting a time difference between a time at which an ultrasonic wave is output from said electro-acoustic transducer means and a time at which said wave is reflected by and returns from said listener to the position of said electro-acoustic transducer means.

10. An ultra-directional speaker system according to claim 1, wherein said virtual sound source setting means comprises a calculating means that calculates, a difference value between a time at which an ultrasonic wave is output from said electro-acoustic transducer means and a time at which an appropriate detection means provided in proximity to said electro-acoustic transducer means detects said ultrasonic wave that is reflected from said listener, and a reflecting means curve rate adjusting means.

11. An ultra-directional speaker system according to claim 10, wherein said reflecting means adjusting means is configured so that it changes the curve rate of said reflecting means in response to an output value of said calculating means.

12. A speaker system drive method for use with an ultra-directional speaker system having a speech generation means, an ultrasonic generation means, an amplitude modulation means to which said speech generation means and said ultrasonic generation means are connected, an electro-acoustic transducer means which converts an ultrasonic modulated signal that is output by the amplitude modulation means to an acoustic signal, and an acoustic reflector that causes the ultrasonic modulated signal output from said electro-acoustic transducer means to be reflected and directed at a prescribed position, said speaker drive system detecting the position of said listener from the ultrasonic wave that is output from said electro-acoustic transducer means and reflected from said listener, and adjusting the curve rate of said reflector.

13. A speaker system drive method according to claim 12, wherein the detection of a position at which said listener exists is performed by calculation of a time difference between a time at which an ultrasonic modulated signal is output from said electro-acoustic transducer means and a time at which said ultrasonic modulated signal is returned to the proximity of said electro-acoustic transducer means after striking said listener.

14. A speaker system drive method according to claim 13, wherein a curve rate of said acoustic reflector is adjusted in response to said difference value.

* * * * *